US009109318B2

(12) United States Patent
Kulkarni et al.

(10) Patent No.: US 9,109,318 B2
(45) Date of Patent: Aug. 18, 2015

(54) INTEGRATION OF BLOWER WITH WASHER MOTOR SHAFT OR DRIVE SHAFT

(71) Applicant: General Electric Company, Schenectady, NY (US)

(72) Inventors: Ashutosh Kulkarni, Bangalore (IN); Gautam Subbarao, Bangalore (IN); Chang Hyun Lee, Louisville, KY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 134 days.

(21) Appl. No.: 13/903,167

(22) Filed: May 28, 2013

(65) Prior Publication Data

US 2014/0352362 A1 Dec. 4, 2014

(51) Int. Cl.

| | |
|---|---|
| ***D06F 25/00*** | (2006.01) |
| ***D06F 58/04*** | (2006.01) |
| ***D06F 58/28*** | (2006.01) |

(52) U.S. Cl.

CPC ..... *D06F 25/00* (2013.01); *D06F 58/28* (2013.01); *D06F 58/04* (2013.01); *D06F 2058/2806* (2013.01); *D06F 2058/2864* (2013.01)

(58) Field of Classification Search

CPC . D06F 25/00; D06F 58/28; D06F 2058/2806; D06F 2058/2864; D06F 58/04; D06F 58/08

USPC ..... 68/15, 19, 20

See application file for complete search history.

(56) References Cited

U.S. PATENT DOCUMENTS

| | | | | |
|---|---|---|---|---|
| 2,225,407 | A * | 12/1940 | Bassett, Jr. | 68/12.21 |
| 3,033,014 | A * | 5/1962 | Neyhouse et al. | 68/19.2 |
| 6,832,441 | B2 | 12/2004 | Jeong et al. | |
| 7,421,865 | B2 | 9/2008 | Lee et al. | |
| 7,707,860 | B2 | 5/2010 | Hong et al. | |
| 2,775,130 | A1 | 11/2011 | Oak et al. | |
| 2011/0225839 | A1* | 9/2011 | Marioni | 34/108 |
| 2012/0260520 | A1* | 10/2012 | Hong et al. | 34/604 |

FOREIGN PATENT DOCUMENTS

| | | | |
|---|---|---|---|
| EP | 2 386 674 | A2 | 11/2011 |
| GB | 973473 | | 10/1964 |
| JP | 2005052682 | A | 3/2005 |

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

A blower is provided having a fan element that is directly connected to a drive shaft. The drive shaft is attached to a wash drum and is rotated by a washer motor. When the washer motor rotates the drive shaft, the fan element also rotates and can move air through the washing machine appliance without the use of an additional blower motor. Alternatively, the fan element of the blower is directly connected to a motor shaft extending from the motor, such that when the motor shaft is rotated, the blower can move air through the washing machine appliance without the use of an additional blower motor.

10 Claims, 10 Drawing Sheets

INTEGRATION OF BLOWER WITH WASHER MOTOR SHAFT OR DRIVE SHAFT

FIELD OF THE INVENTION

The subject matter of the present disclosure relates generally to a washing machine appliance having a blower integrated with a motor shaft or a drive shaft.

BACKGROUND OF THE INVENTION

A horizontal axis washing machine appliance generally includes a cabinet with a wash tub mounted therein. A wash drum can be rotatably mounted within the wash tub and can receive articles for washing through an opening. The wash drum generally includes a plurality of holes so as to allow the flow of a fluid, such as air or a wash liquid, between the wash drum and wash tub.

During a wash cycle of the washing machine appliance, wash liquid, e.g., detergent, fabric softener, water, and/or bleach, can fill the wash tub to an appropriate level and be applied to articles within the wash basket. Such wash liquid can assist with cleaning of the articles, e.g., as the articles are agitated during the wash cycle. After the wash cycle, the washing machine appliance can rinse the wash fluid from the articles using, e.g., fresh water. Before and/or after the rinse cycle, the washing machine appliance can initiate one or more spin cycles to remove liquids from the articles. During the spin cycles, the wash drum is rotated by a washer motor within the wash tub to wring liquid from the articles, such that liquid flows out of the articles, through the plurality of holes in the wash drum, and drains out of the wash tub.

Following one or more wash cycles and spin cycles, the washing machine appliance can be equipped to initiate a drying cycle, also referred to as an overnight drying cycle, so as to provide washed and dried articles to the user without the need for the user to, e.g., stay up later than desired or wake up earlier than desired, to switch the washed clothes to a drier after washing. The combination of a wash and overnight drying cycle can be configured to last approximately as long as the expected sleep time of the user, so the dried clothes do not have time to settle within the wash drum and, e.g., develop wrinkles.

During an overnight drying cycle, the washing machine appliance can dry the articles by rotating the wash drum within the wash tub using the washer motor, and by providing airflow to the wash drum to remove moisture from the air and the articles using a blower. Additionally, the articles may be dried without supplying any external heat to the airflow. Generally, air is introduced through an inlet port positioned in the wash tub, flows through the plurality of holes in the wash drum, and then exits through an exhaust port positioned near the opening of the wash drum.

The blower generally requires a separate blower motor connected to a main power supply, such that during e.g., an overnight drying cycle, both the washer motor and blower motor may be operating. Certain problems can exist with such a configuration, however. For example, running the blower using a separate blower motor through the duration of an overnight drying cycle can require a significant amount of additional power. Accordingly, a washing machine appliance having one or more features that can reduce the amount of power used during operation of the blower and the washer motor would be useful.

BRIEF DESCRIPTION OF THE INVENTION

The present disclosure provides a blower having a fan element that is directly connected to a drive shaft. The drive shaft is attached to a wash drum and is rotated by a washer motor. When the washer motor rotates the drive shaft, the fan element also rotates and can move air through the washing machine appliance without the use of an additional blower motor. Alternatively, the fan element of the blower is directly connected to a motor shaft extending from the motor, such that when the motor shaft is rotated, the blower can move air through the washing machine appliance without the use of an additional blower motor. Additional aspects and advantages of the present disclosure will be set forth in part in the following description, or may be apparent from the description, or may be learned through practice of the disclosure.

In one exemplary embodiment of the present disclosure, a washing machine appliance is provided, including a wash tub, and a wash drum rotatably mounted within the wash tub and configured to rotate about an axial direction. The washing machine appliance also includes a drive shaft extending from the wash drum in the axial direction and configured to rotate the wash drum, and a washer motor in mechanical communication with the drive shaft and configured to selectively rotate the drive shaft. Additionally, the washing machine appliance includes a blower having a fan element directly connected to the drive shaft and in fluid communication with the wash tub and the wash drum, such that the blower provides an airflow to the wash tub and the wash drum when the drive shaft is rotated by the washer motor.

In another exemplary embodiment of the present disclosure, a washing machine appliance is provided, including a wash tub, and a wash drum rotatably mounted within the wash tub and configured to rotate about an axial direction. The washing machine appliance also includes a motor shaft in mechanical communication with the wash drum, and a washer motor configured to selectively rotate the motor shaft, wherein the motor shaft extends from the washer motor. Additionally, the washing machine appliance includes a blower having a fan element directly connected to the motor shaft and in fluid communication with the wash tub and the wash drum, such that the blower provides an airflow to the wash tub and the wash drum when the motor shaft is rotated by the washer motor.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
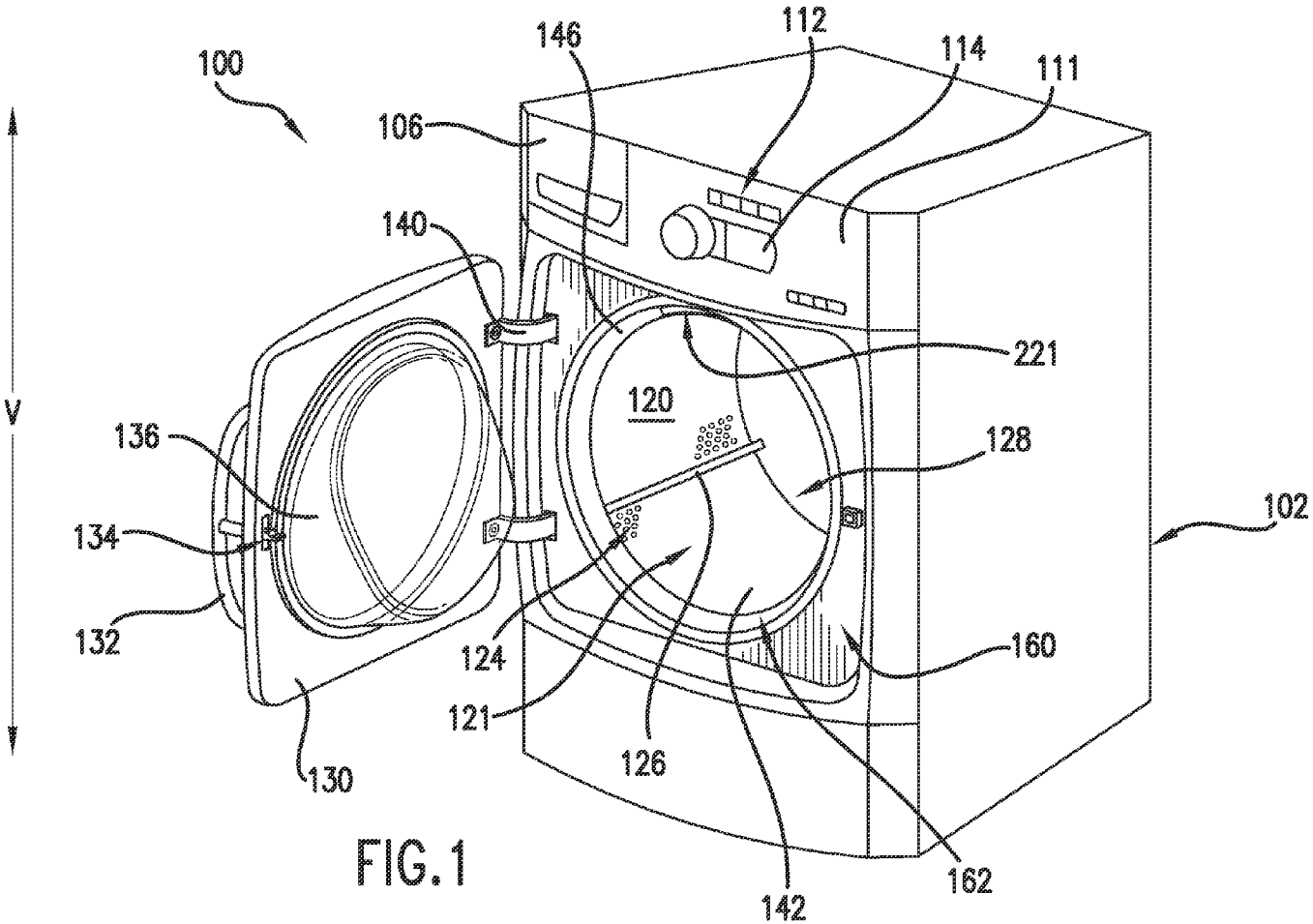
FIG. 1 provides a perspective view of an exemplary embodiment of a washing machine appliance of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Figure 2:
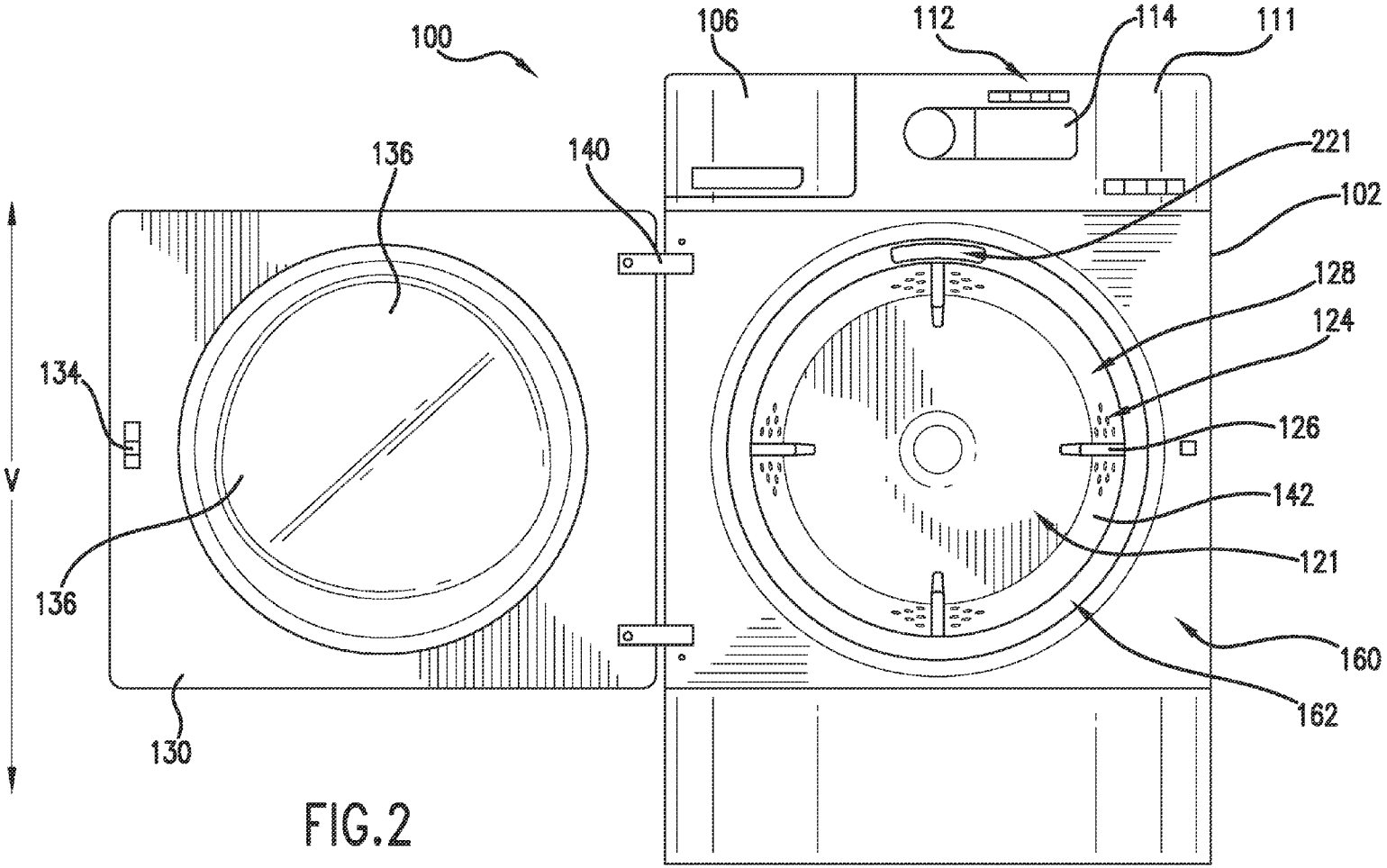
FIG. 2 provides a front view of the washing machine appliance of FIG. 1 with a door shown in an open position.

FIGS. 1 and 2 illustrate an exemplary washing machine appliance 100, depicted as a horizontal axis washing machine appliance. However, while described in the context of a specific embodiment of washing machine appliance 100, using the teachings disclosed herein, it will be understood that washing machine appliance 100 is provided by way of example only. Other washing machine appliances having different configurations, different orientations (e.g., a vertically oriented washing machine appliance), different appearances, and/or different features may also be utilized with the present subject matter as well.

Washing machine appliance 100 has a cabinet 102 defining a vertical direction V, with a wash drum 120 rotatably mounted therein. Drum 120 defines an opening 128 configured for receiving articles to be washed, dried, or both, into a wash chamber 121 defined by wash drum 120. Additionally, drum 120 defines a cylindrically-shaped wall 142 extending from opening 128. A plurality of holes 124 are positioned along wall 142. The plurality of holes 124 facilitate a flow to and from drum 120 of a fluid, such as a wash fluid or air.

A plurality of ribs 126 extend from wall 142 of drum 120 into wash chamber 121. Ribs 126 assist in agitation of articles disposed within wash chamber 121 during operation of washing machine appliance 100. For example, ribs 126 may lift articles disposed in drum 120 during rotation of drum 120. A detergent drawer 106 is slidably mounted within cabinet 102. Detergent drawer 106 receives detergent and directs the detergent to wash chamber 121 during operation of appliance 100.

As shown in FIGS. 1 and 2, cabinet 102 of washing machine appliance 100 has a door casing assembly 160. Door casing assembly 160 defines an opening 162 that permits a user to access opening 128 and wash chamber 121 of drum 120. A door 130 is mounted to door casing assembly 160 by two hinges 140 and is configured to close off openings 162 and 128 of door casing assembly 160 and drum 120, respectively. A window 136 in door 130 permits viewing of wash chamber 121 during operation of appliance 100. Door 130 also includes a handle 132 that, e.g., a user may pull when opening and closing door 130. Latch 134 is configured for selectively securing door 130 in a closed configuration (not shown).

Washing machine appliance 100 also includes a gasket 146 positioned at opening 128 of drum 120 that creates a fluid seal between door 130 and door casing assembly 160 when door 130 is in a closed configuration (i.e., a configuration in which door 130 is positioned adjacent cabinet 102). Additionally, a first port 221 is positioned in gasket 146 that can e.g., provide air to wash drum 120 during various methods of operation of washing machine appliance 100.

Referring still to FIGS. 1 and 2, a control panel 111 with a plurality of input selectors 112 is also mounted to cabinet 102. Control panel 111 and input selectors 112 collectively form a user interface for user selection of machine cycles and features. A display 114 of control panel 111 indicates selected features, a countdown timer, and/or other items of interest to appliance users.

Operation of washing machine appliance 100 is controlled by a controller or processing device (not shown), that is operatively coupled to control panel 111 for user manipulation to select washing machine cycles and features. In response to user manipulation of control panel 111, the controller operates the various components of washing machine appliance 100 to execute selected machine cycles and features.

In an illustrative aspect of the present disclosure, articles or laundry items are loaded into wash chamber 121, and a washing operation is initiated through user manipulation of input selectors 112. A portion of drum 120 is filled with water and detergent to form a wash fluid. One or more valves (not shown) can be controlled by washing machine appliance 100 to provide for filling drum 120 to an appropriate level for the amount of articles being washed. Once drum 120 is properly filled with fluid, the contents of wash chamber 121 are agitated with ribs 126 for cleansing of laundry items in drum 120.

After the agitation phase of the wash cycle is completed, drum 120 is drained. Laundry articles can then be rinsed by again adding fluid such as water to drum 120 and depending on the particulars of the cleaning cycle selected by a user, ribs 126 may again provide agitation within wash chamber 121. The fluid is again drained from drum 120. Appliance 100 also uses one or more spin cycles, wherein wash drum 120 is rotated at a relatively high RPM in order to wring wash fluid from the articles being washed. In particular, a spin cycle may be applied after the wash cycle and/or after the rinse cycle. Following the last spin cycle, washing machine appliance 100 can commence an overnight drying cycle, wherein wash drum 120 is rotated at a relatively low RPM and an airflow is provided therethrough, such that articles in appliance 100 can be dried.

Figure 3:
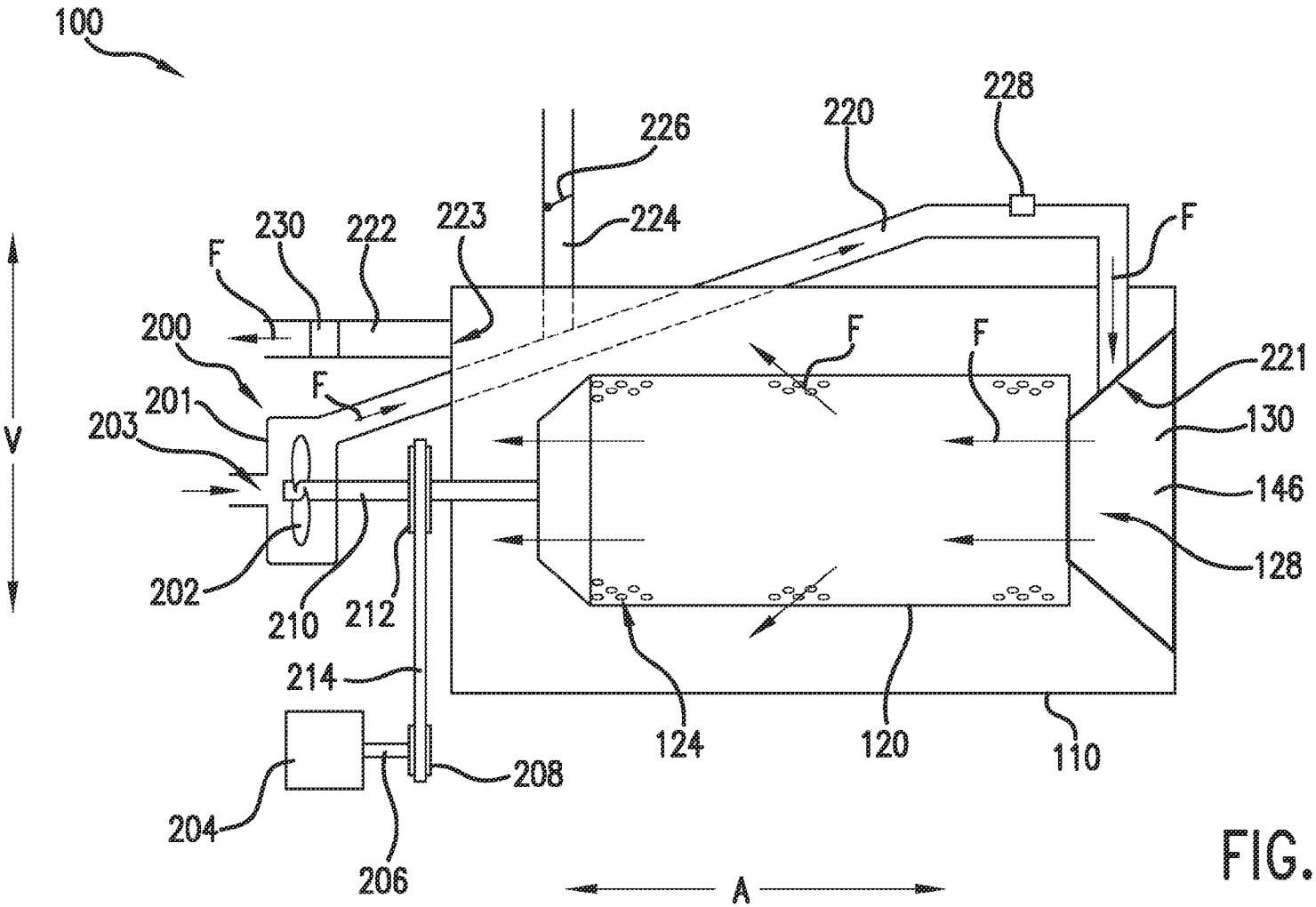
FIG. 3 provides a schematic illustration of an exemplary embodiment of a washing machine appliance of the present disclosure having a blower mounted to a drive shaft.

Referring now to FIG. 3, a schematic illustration is provided of an exemplary embodiment of washing machine appliance 100. As is represented schematically in FIG. 3, wash drum 120 is mounted within a wash tub 110 positioned in cabinet 102 of washing machine appliance 100 (see FIGS. 1 and 2). Further, wash drum 120 is rotatably mounted within wash tub 110 and each are in fluid communication with one another through the plurality of holes 124 defined by wash drum 120. Washing machine appliance 100 also defines an axial direction A that is orthogonal to the vertical direction V and further includes a drive shaft 210 extending from said wash drum 120 along the axial direction A. Drive shaft 210 is attached to wash drum 120 and is configured to rotate wash drum 120 about the axial direction A.

Additionally, exemplary washing machine appliance 100 includes a washer motor 204 in mechanical communication with drive shaft 210 and configured to selectively rotate drive shaft 210. More particularly, motor 204 includes a motor shaft 206 extending therefrom with a motor drive wheel 208 attached to motor shaft 206. The motor drive wheel 208 is in mechanical communication with a drive shaft drive wheel 212 by way of a drive belt 214. Rotation of motor shaft 206 by motor 204 rotates motor drive wheel 208, which correspondingly rotates drive shaft drive wheel 212 using belt 214, and in turn rotates drive shaft 210 and wash drum 120.

Further, exemplary washing machine appliance 100 includes a first duct 220 in fluid communication with first port 221 and a second duct 222 in fluid communication with a second port 223. First port 221 is positioned proximate to opening 128 in wash drum 120 and second port 223 is positioned in wash tub 110, such that first and second ports 221, 223 are each in fluid communication with wash tub 110 and wash drum 120. Additionally, first duct 220 is in fluid communication with a blower 200, such that blower 200 is also in fluid communication with wash drum 120 and wash tub 110. Blower 200 includes a blower housing 201 and a fan element 202 positioned therein. Fan element 202 is directly connected to drive shaft 210 and is configured to move air between a blower port 203 and first duct 220. For the exemplary embodiment of FIG. 3, the fan element 202 of blower 200 is an impeller; other configurations may be used as well.

As shown in FIG. 3, blower 200 is configured to provide an airflow F to wash drum 120 and wash tub 110. More particularly, for the exemplary embodiment of FIG. 3, blower 200 provides an airflow F in a direction from blower 200, through first duct 220, and to wash tub 110 and wash drum 120 when drive shaft 210 is rotated by motor 204. As such, first duct 220 and first port 221 are configured as an inlet duct and an inlet port, respectively. Additionally, duct 222 and port 223 are configured as an exhaust duct and an exhaust port, respectively. Further, a lint filter 230 is positioned in duct 222 and is configured to remove at least a portion of the lint from the air exhausted from washing machine appliance 100.

By attaching fan element 202 of blower 200 directly to drive shaft 210, washing machine appliance can operate blower 200 without the need for an additional blower motor. Such a configuration can therefore allow washing machine appliance 100 to utilize less power during operation of blower 200 and washer motor 204 than it otherwise would if a separate blower motor were necessary. Further, by directly attaching blower 200 to drive shaft 210 as opposed to, e.g., utilizing a transmission device therebetween, a simpler configuration is allowed, with fewer parts required.

It should be appreciated, however, that the above washing machine appliance 100 is provided by way of example only. In other exemplary embodiments of the present disclosure, washing machine appliance 100 may have any other suitable configuration. For example, in other exemplary embodiments any other suitable transmission means may be provided for transferring mechanical energy from motor 204 to drive shaft 210. Additionally, in other exemplary embodiments, washing machine appliance 100 can have any other suitable configuration for first and second ducts 220, 222 and ports 221, 223. For example, first and second ports 221, 223 can each be positioned in wash tub 110, or alternatively first port 221 can be positioned in wash tub 110 and second port 223 can be positioned proximate to opening 128 in wash drum 120. Further, fan element 202 of blower 200 can be any other suitable means for moving air between blower port 203 and first duct 220.

Referring still to FIG. 3 washing machine appliance 100 is configured such that the amount of airflow F provided by blower 200 to wash drum 120 and wash tub 110 varies with the rotational speed of the wash drum 120. Such functionality is provided by impeller 202 of blower 200 being directly connected to drive shaft 210, and therefore rotating at the same rotational speed as drive shaft 210 and wash drum 120.

By way of example, during an overnight drying cycle, motor 204 can rotate drive shaft 210, and thus impeller 202 and wash drum 120, at a relatively low rotational speed, as measured in revolutions per minute (RPM). During such a cycle, blower 200 therefore provides wash tub 110 and wash drum 120 with a relatively low amount of airflow. For example, during an overnight drying cycle an exemplary blower 200 can be configured to provide an airflow F to wash drum 120 and wash tub 110 between about 10 cubic feet per minute (cfm) and about 100 cfm. Alternatively, during an overnight drying cycle another exemplary blower 200 can be configured to provide an airflow F to wash drum 120 and wash tub 110 between about 15 cfm and about 50 cfm. In still another exemplary embodiment, blower 200 can be configured to provide an airflow during an overnight drying cycle of about 36 cfm.

By contrast, during other cycles, such as a spin cycle, motor 204 can rotate drive shaft 210, and thus impeller 202 and wash drum 120, at a relatively high RPM. As such, during a spin cycle blower 200 can provide wash tub 110 and wash drum 120 with a relatively high amount of airflow. For example, during a spin cycle, an exemplary blower 200 can be configured to provide an airflow F to wash drum 120 and wash tub 110 between about 100 cfm and about 220 cfm. Alternatively, during a spin cycle another exemplary blower 200 can be configured to provide an airflow F to wash drum 120 and wash tub 110 between about 120 cfm and about 200 cfm. In still another exemplary embodiment, blower 200 can be configured to provide an airflow during a spin cycle of about 180 cfm.

It should be appreciated, however, that the ranges discussed regarding the amount of airflow F provided to wash drum 120 and wash tub 110 during an overnight drying cycle and a spin cycle are given by way of example only. For example, in other exemplary embodiments, it may be desirable for blower 200 to be configured to provide an airflow of less than about 10 cfm or more than about 100 cfm during an overnight drying cycle, or less that about 100 cfm or more than about 220 cfm during a spin cycle.

During operation of washing machine appliance 100, however, it may be determined that blower 200 provides more airflow to wash tub 110 and wash drum 120 than is required and/or is desirable. For example, in the exemplary embodiment of FIG. 3 when the velocity of the air in airflow F through first duct 220 to wash drum 120 and wash tub 110 exceeds a certain velocity threshold ($V_{THR}$), the washing machine appliance 100 might generate unacceptable noise levels. One having ordinary skill in the art will recognize that the velocity of the air in airflow F through first duct 220 corresponds directly to the amount of airflow F through first duct 220.

Accordingly, a sensor 228 is provided for the exemplary embodiment of FIG. 3, positioned in first duct 220 and configured to determine an operating parameter of the airflow F provided by blower 200 through first duct 220 to wash tub 110 and wash drum 120. More particularly, for the exemplary embodiment of FIG. 3, sensor 228 is positioned in first duct 220 and configured to determine the velocity of the air in airflow F provided by blower 200 through first duct 220 to wash tub 110 and wash drum 120. Sensor 228 can be operatively coupled to the controller of washing machine appliance 100, such that sensor 228 communicates to the controller the velocity of the air in airflow F through first duct 220.

Additionally, an air bypass system is included for the exemplary embodiment of FIG. 3 to bypass a portion of the airflow F from first duct 220. More particularly, washing machine appliance 100 includes a bypass duct 224 in fluid communication with first duct 220, and a one way bypass valve 226 positioned in bypass duct 224. One way bypass valve 226 is moveable between an open position and a closed position (shown in FIG. 3). When valve 226 is in a closed position, air may not flow from first duct 220 through bypass duct 224. However, when valve 226 is in an open position, bypass duct 224 is configured to allow a flow of air through bypass duct 224 in a direction from first duct 220. Such a configuration can allow the bypass system to prevent the velocity of the air in airflow F through first duct 220 downstream of bypass duct 224 from exceeding or coming within a predetermined range of $V_{THR}$.

As such, one way bypass valve 226 can be configured to open when the velocity of the air in airflow F through first duct 220 to wash tub 110 and wash drum 120 exceeds or comes within a predetermined range of $V_{THR}$. Further, one way bypass valve 226 can be an electromechanical valve controlled by the controller of washing machine appliance 100 (discussed with reference to FIGS. 1 and 2). In such an embodiment, sensor 228 can communicate the velocity of the air in airflow F through first duct 220 to the controller, such that when the velocity of the air in the airflow exceeds or comes within a predetermined range of $V_{THR}$, the controller opens one way bypass valve 226. Further, such an embodiment can allow the refrigerator appliance 100 to maintain the maximum allowed airflow for a spin cycle or an overnight drying cycle.

By way of example, for the exemplary embodiment of FIG. 3, $V_{THR}$ can be between about 8 meters per second (m/s) and about 30 m/s. Alternatively, $V_{THR}$ can be between about 12 m/s and about 24 m/s. In still another exemplary embodiment, $V_{THR}$ can be about 14 m/s. It should be appreciated, however, that the ranges provided are by way of example only, and in other exemplary embodiments, $V_{THR}$ can be lower than about 8 m/s or $V_{THR}$ can be higher than about 30 m/s.

It should also be appreciated, however, that in other exemplary embodiments of washing machine appliance 100, the air bypass system, including one way bypass valve 226, can have any other suitable configuration. For example, in other exemplary embodiments, valve 226 can be a mechanical valve, such as a spring loaded flap valve, and can be configured to open based on, e.g., the differential pressure in bypass duct 224 upstream and downstream of valve 226. Alternatively, the controller can be configured to open valve 226 based on any other suitable operating parameter of washing machine appliance 100. For example, valve 226 can be configured to open based on a rotational speed of drive shaft 210, the amount of airflow F through wash drum 120 and wash tub 110, or the pressure in one or more of first duct 220, second duct 222, or wash tub 110.

It should further be appreciated that the term "valve" as used herein refers generally to a one way bypass mechanism. Accordingly, in other exemplary embodiments, valve 226 could by any suitably one way bypass mechanism.

Accordingly, in other exemplary embodiments, sensor 228, if required, can be configured to measure or otherwise determine any other suitable operating parameter of washing machine appliance 100 and can be positioned in any other suitable location in washing machine appliance 100. For example, sensor 228 can be configured to measure or otherwise determine the amount of airflow F through wash drum 120 and wash tub 110, and/or can be positioned in first duct 220 upstream from bypass duct 224 or in second duct 222.

Still referring to the exemplary embodiment of washing machine appliance 100 of FIG. 3, the airflow F entering blower port 203 can be ambient air, and the airflow F exhausting through second duct 222, and potentially bypass duct 224, can be exhausted to the ambient. In other exemplary embodiments, however, a portion of, or all of, the air that exhausts through second duct 222 and/or bypass duct 224 can be redirected to blower port 203.

Figure 4:
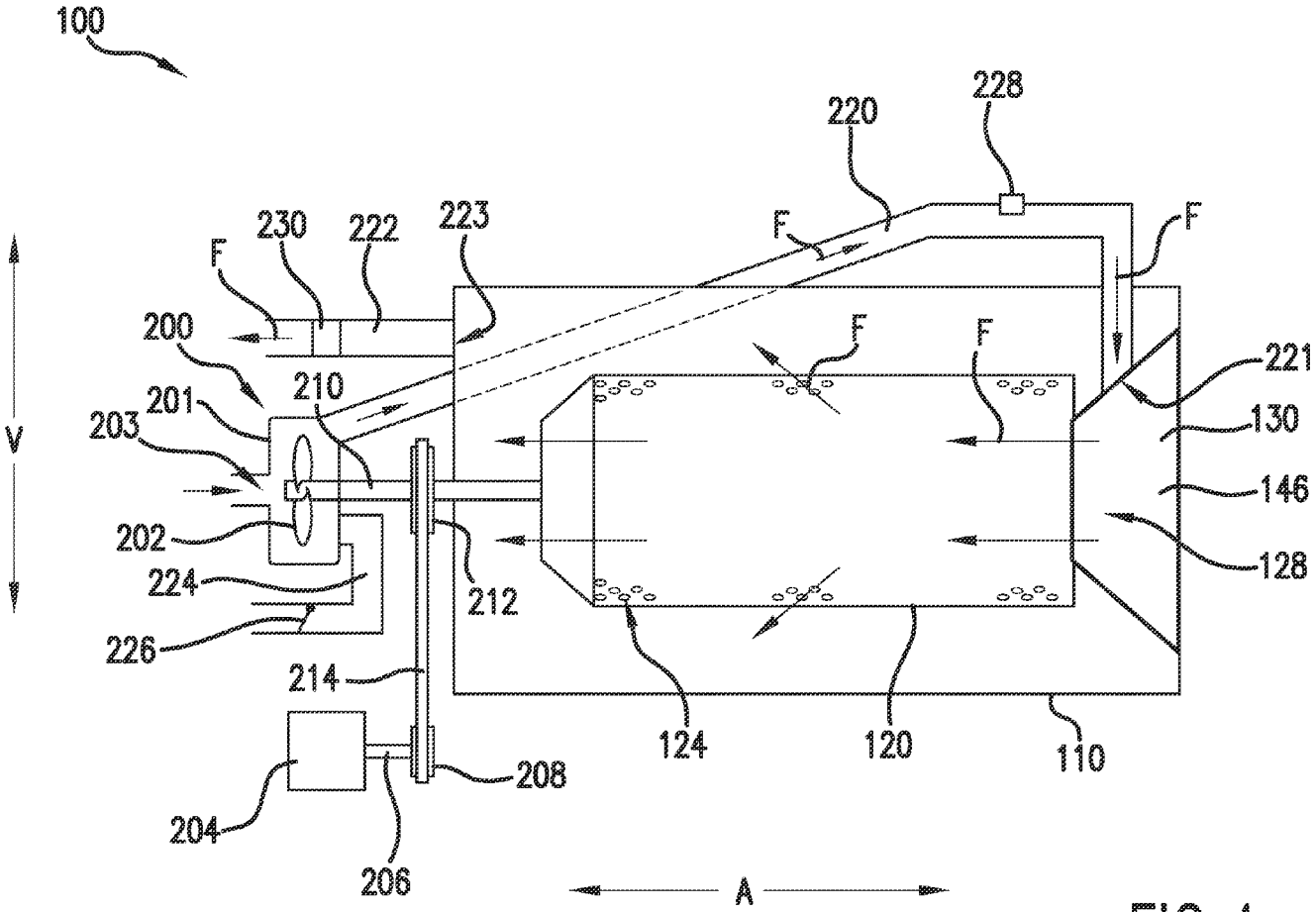
FIG. 4 provides a schematic illustration of another exemplary embodiment of a washing machine appliance of the present disclosure having a blower in communication with a bypass duct.

Referring now to FIG. 4, a schematic illustration of another exemplary embodiment of washing machine appliance 100 is provided. The exemplary embodiment of washing machine appliance 100 of FIG. 4 operates similarly to the exemplary washing machine appliance of FIG. 3, with a few distinctions.

For the exemplary embodiment of FIG. 4, bypass duct 224 is attached to and in fluid communication with blower 200, such that bypass duct 224 is configured to allow a flow of air in a direction from blower 200 and through bypass duct 224 when valve 226 is opened. More particularly, as shown, bypass duct 224 is attached to housing 201 of blower 200, such that when valve 226 is opened, a portion of the airflow F can flow directly from blower 200 through bypass duct 224.

Figure 5:
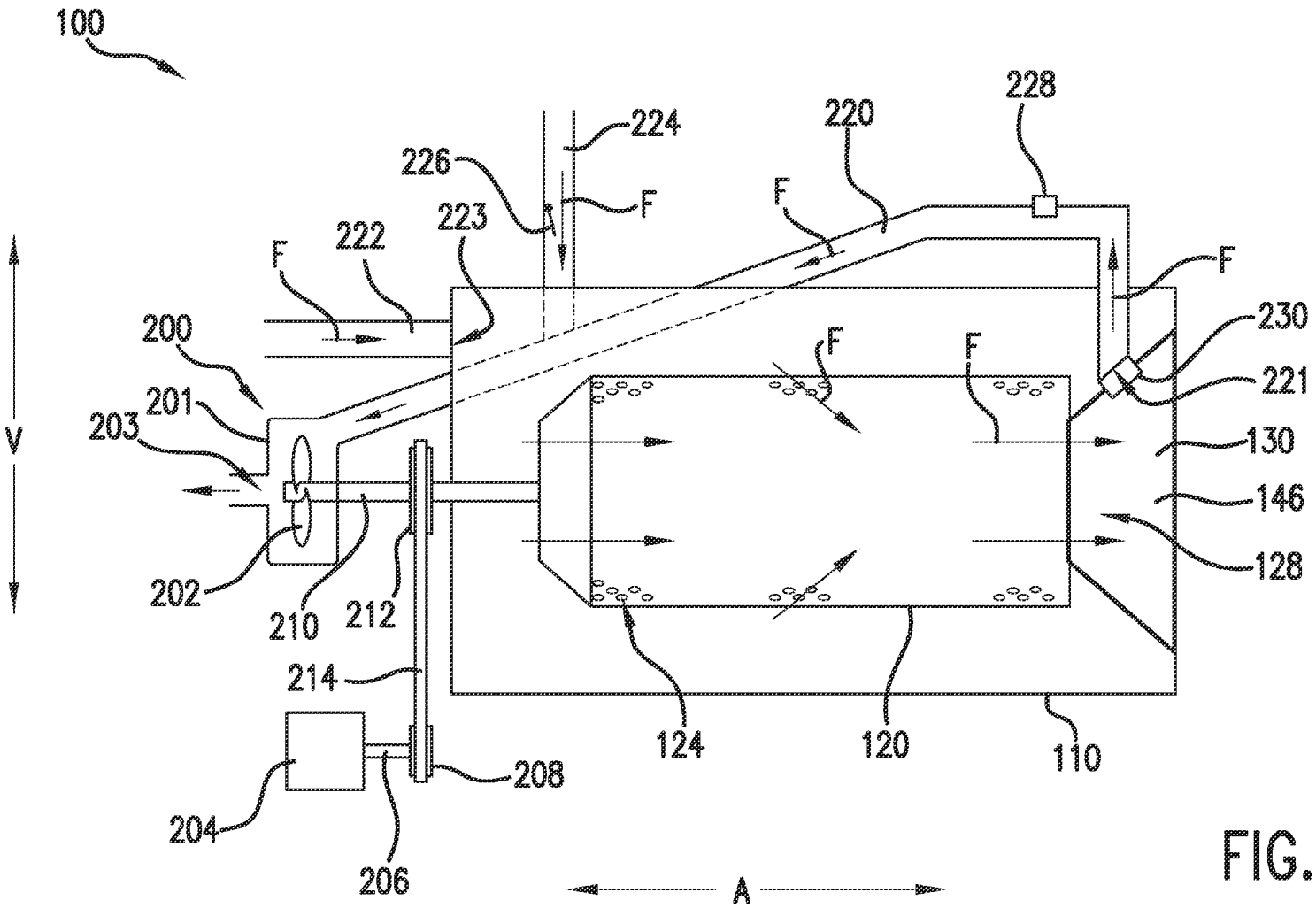
FIG. 5 provides a schematic illustration of still another exemplary embodiment of a washing machine appliance of the present disclosure having a blower in communication with an exhaust duct.
Figure 6:
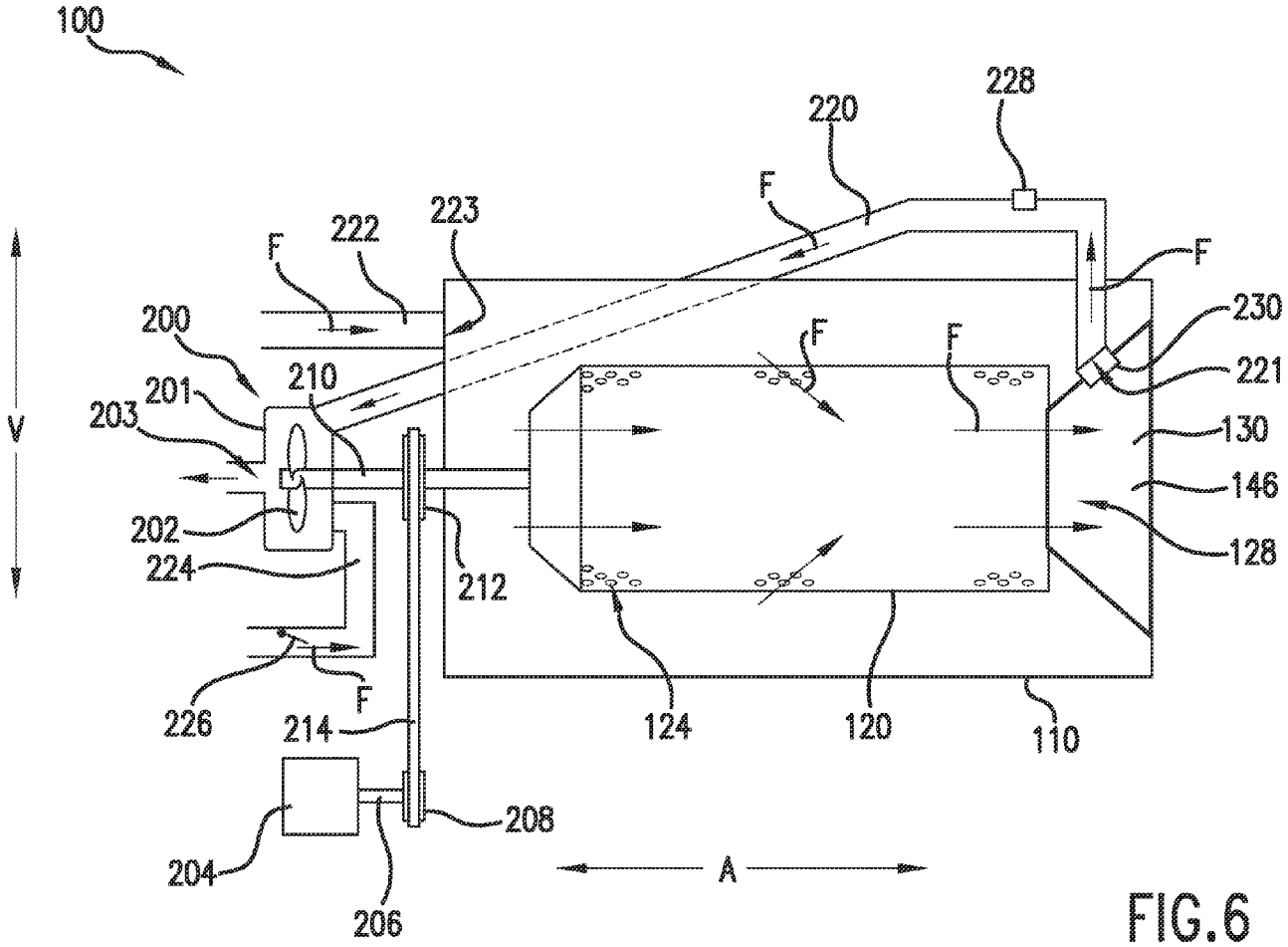
FIG. 6 provides a schematic illustration of yet another exemplary embodiment of a washing machine appliance of the present disclosure having a blower in communication with an exhaust duct and a bypass duct.
Figure 7:
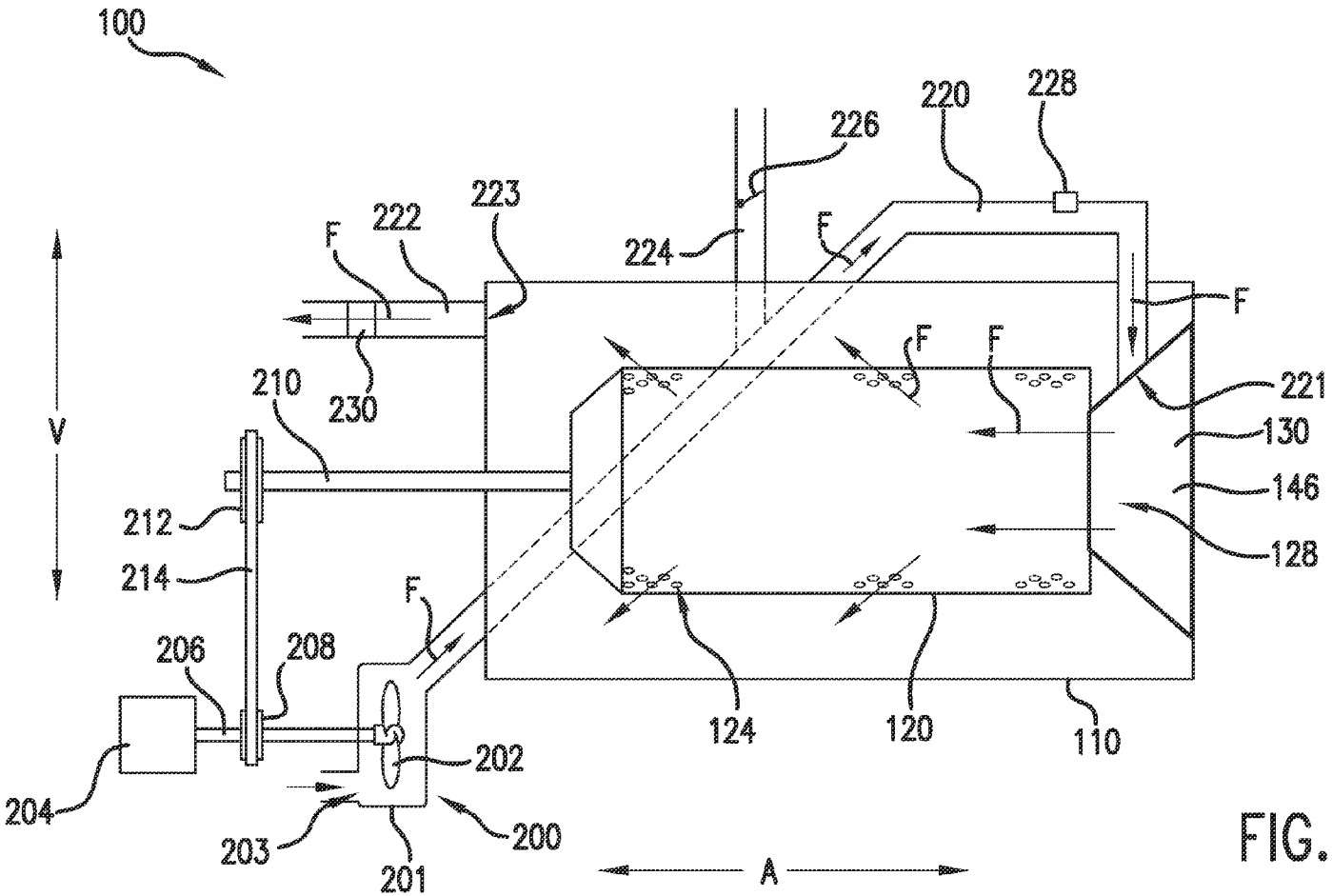
FIG. 7 provides a schematic illustration of another exemplary embodiment of a washing machine appliance of the present disclosure having a blower mounted to a motor shaft.
Figure 8:
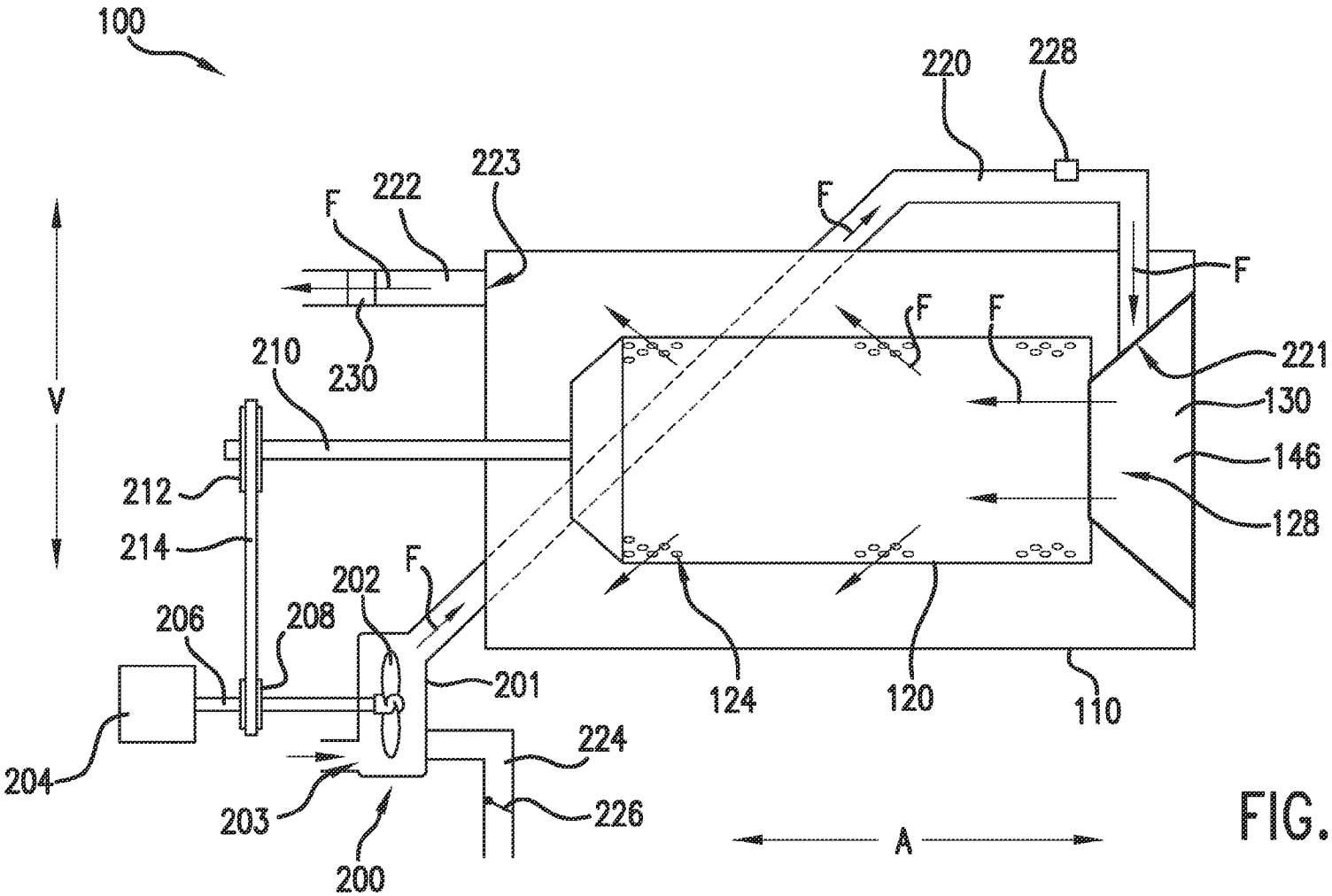
FIG. 8 provides a schematic illustration of still another exemplary embodiment of a washing machine appliance of the present disclosure having a blower mounted to a motor shaft and in communication with a bypass duct.
Figure 9:
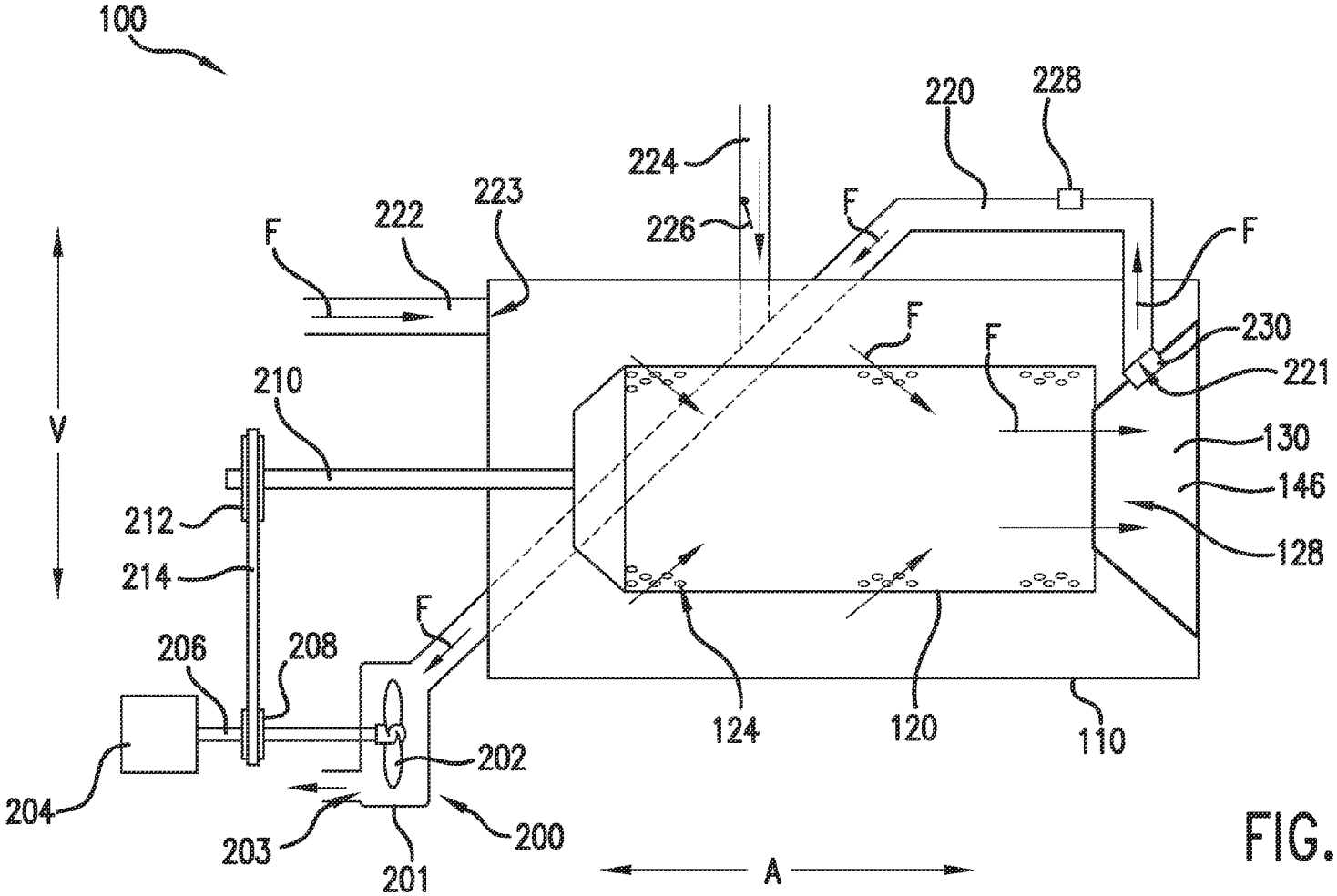
FIG. 9 provides a schematic illustration of yet another exemplary embodiment of a washing machine appliance of the present disclosure having a blower a blower mounted to a motor shaft and in communication with an exhaust duct.
Figure 10:
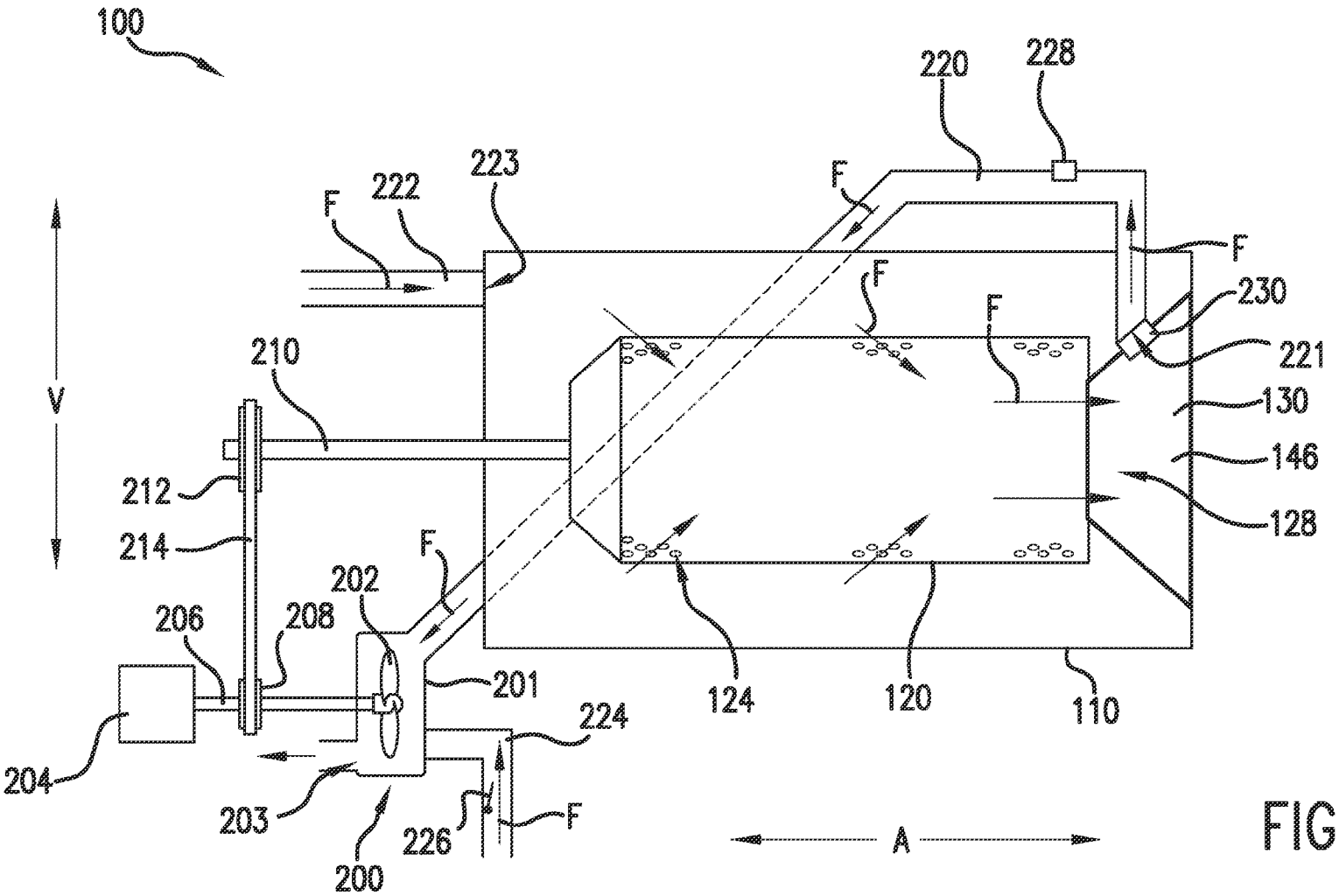
FIG. 10 provides a schematic illustration of yet another exemplary embodiment of a washing machine appliance of the present disclosure having a blower mounted to a motor shaft, and in communication with a bypass duct and an exhaust duct.

Referring now to FIGS. 5 and 6, schematic illustrations of two additional exemplary embodiments of a washing machine appliance 100 of the present disclosure are provided. Operation of the exemplary embodiments of washing machine appliance 100 provided in FIGS. 5 and 6 is similar to the operation of the exemplary embodiments of FIGS. 3 and 4, respectively, with certain distinctions.

Most notably, in the exemplary embodiments of washing machine appliance 100 provided in FIGS. 5 and 6, the airflow F is reversed as compared to the exemplary embodiments of FIGS. 3 and 4. More particularly, for the exemplary embodiments of FIGS. 5 and 6, when drive shaft 210 is rotated, blower 200 is configured to move air from wash tub 110 and wash drum 120, through first port 221 and first duct 220, to blower 200, and out through blower port 203. Therefore, for the exemplary embodiments of FIGS. 5 and 6, first duct 220 is an exhaust duct and first port 221 is an exhaust port. Additionally, second duct 222 is an inlet duct and second port 223 is an inlet port—air is provided to wash drum 120 and wash tub 110 through second duct 222 and second port 223. Further, as may be seen in FIGS. 5 and 6, lint filter 230 is positioned at first port 221.

Additionally, when bypass valve 226 is in the open position, the flow of air through bypass duct 224 is reversed as well. More specifically, when valve 226 is in the open position, as shown in FIGS. 5 and 6, air can flow in a direction through bypass duct 224 towards first duct 220, i.e. the exhaust duct (FIG. 5), or through bypass duct 224 towards the blower 200 (FIG. 6). Such configurations can reduce the velocity of the air in airflow through first duct 220 (upstream of bypass duct 224 for the exemplary embodiment of FIG. 5) when valve 226 is in the open position. Further, for the exemplary embodiments of FIGS. 5 and 6, the air flowing through bypass duct 224 and/or second duct 222 can be ambient air, and air exhausting through first duct 220 and out through blower port 203 can be exhausted to the ambient.

Referring now to FIGS. 7, 8, 9 and 10, schematic illustrations of four additional exemplary embodiments are provided. Operation of the exemplary embodiments of washing machine appliance 100 provided in FIGS. 7, 8, 9, and 10 is similar to the exemplary embodiments of FIGS. 3, 4, 5, and 6, respectively, with a few notable distinctions.

With the exemplary embodiments of FIGS. 7, 8, 9, and 10, blower 200 is mounted on the motor shaft 206 of motor 204 as opposed to the drive shaft 210 extending from drum 120. More particularly, in each of the exemplary embodiments of FIGS. 7, 8, 9, and 10, fan element 202 is directly connected to the motor shaft 206 of washer motor 204. Such a configuration can allow for the same benefits of mounting blower 200 on drive shaft 210, such as, allowing for variable amounts of airflow through wash tub 110 and wash drum 120, a reduction in the power required to operate blower 200 and washer motor 204, and/or a simpler configuration.

It should be appreciated, however, that the term "motor shaft" as used herein refers generally to any non-stationary portion of the motor. For example, in one exemplary embodiment motor 204 may be an electric motor and fan element 202 may be mounted at any suitable location on the rotor. It should also be appreciated that although for the exemplary embodiments of FIGS. 7-10, motor 204 is shown offset from drive shaft 210, in other exemplary embodiments of the present disclosure, motor 204 may be a direct drive motor. In such an exemplary embodiment, motor shaft 206 may be configured to rotated wash drum 120 directly and fan may be mounted at any suitable location on the motor shaft 206.

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a wash tub;

a wash drum rotatably mounted within said wash tub and configured to rotate about an axial direction;

a drive shaft extending from said wash drum in the axial direction and configured to rotate said wash drum;

a washer motor in mechanical communication with said drive shaft and configured to selectively rotate said drive shaft; and a blower having a fan element directly attached to said drive shaft and in fluid communication with said wash tub and said wash drum, such that said blower provides an airflow to said wash tub and said wash drum when said drive shaft is rotated by said washer motor.

2. A washing machine appliance as in claim 1, wherein said fan element comprises an impeller.

3. A washing machine appliance as in claim 1, wherein the airflow provided to said wash drum and said wash tub is in a range of about 15 cfm to about 50 cfm during an overnight dry cycle.

4. A washing machine appliance as in claim 1, further comprising an inlet duct in fluid communication with said blower, said wash tub, and said wash drum, said blower configured to provide an airflow in a direction from said blower, through said inlet duct, and to said wash tub and said wash drum.

5. A washing machine appliance as in claim 4, further comprising an air bypass system, wherein said air bypass system comprises:

a bypass duct in fluid communication with said inlet duct; and a one way bypass valve positioned in said bypass duct and configured to allow a flow of air in a direction from said inlet duct when a velocity of the air exceeds a $V_{THR}$ in said inlet duct;

wherein $V_{THR}$ is between about 8 m/s and about 30 m/s.

6. A washing machine appliance as in claim 4, further comprising an air bypass system, wherein said air bypass system comprises:

a bypass duct attached to and in fluid communication with said blower; and a one way bypass valve positioned in said bypass duct and configured to allow a flow of air in a direction from said blower when a velocity of the air exceeds a $V_{THR}$ in said inlet duct;

wherein $V_{THR}$ is between about 8 m/s and about 30 m/s.

7. A washing machine appliance as in claim 1, further comprising an exhaust duct in fluid communication with said blower, said wash tub, and said wash drum, wherein said blower is configured to provide an airflow in a direction from said wash drum and said wash tub, through said exhaust duct, and to said blower.

8. A washing machine appliance as in claim 7, further comprising an air bypass system, wherein said air bypass system comprises:

a bypass duct in fluid communication with said exhaust duct; and a one way bypass valve positioned in said bypass duct and configured to allow a flow of air in a direction to said exhaust duct when a velocity of the air exceeds a $V_{THR}$ in said exhaust duct;

wherein $V_{THR}$ is between about 8 m/s and about 30 m/s.

9. A washing machine appliance as in claim 7, further comprising an air bypass system, wherein said air bypass system comprises:

a bypass duct attached to and in fluid communication with said blower; and a one way bypass valve positioned in said bypass duct and configured to allow a flow of air in a direction through said bypass duct to said blower when a velocity of the air exceeds a $V_{THR}$ in said exhaust duct;

wherein $V_{THR}$ is between about 8 m/s and about 30 m/s.

10. A washing machine appliance as in claim 1, further comprising a first duct in fluid communication with said blower, said wash drum, and said wash tub, and a sensor positioned in said first duct configured to determine an operating parameter of the airflow traveling therethrough.

* * * * *